US010245859B1

(12) United States Patent
Tsai

(10) Patent No.: US 10,245,859 B1
(45) Date of Patent: Apr. 2, 2019

(54) PAPER FEEDING MECHANISM

(71) Applicant: FOXLINK IMAGE TECHNOLOGY CO., LTD., New Taipei (TW)

(72) Inventor: Wei Xiang Tsai, New Taipei (TW)

(73) Assignee: FOXLINK IMAGE TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/972,286

(22) Filed: May 7, 2018

(51) Int. Cl.

| | |
|---|---|
| ***B65H 3/06*** | (2006.01) |
| ***B41J 13/076*** | (2006.01) |
| *B41J 13/00* | (2006.01) |
| *B41J 13/14* | (2006.01) |
| *B41J 23/02* | (2006.01) |

(52) U.S. Cl.
CPC ..... *B41J 13/076* (2013.01); *B41J 13/009* (2013.01); *B41J 13/14* (2013.01); *B41J 23/02* (2013.01); *B65H 3/06* (2013.01)

(58) Field of Classification Search
CPC ..... B41J 13/009; B41J 13/14; B41J 23/02; B65H 3/06
USPC ..... 347/104
See application file for complete search history.

(56) References Cited

U.S. PATENT DOCUMENTS

2003/0178763 A1* 9/2003 Hiramitsu ..... B65H 3/0623 271/152

* cited by examiner

*Primary Examiner* — Huan H Tran
*Assistant Examiner* — Alexander D Shenderov
(74) *Attorney, Agent, or Firm* — WPAT, PC

(57) ABSTRACT

A paper feeding mechanism includes a lower frame, an upper frame, a separation roller, a pickup roller, a paper feeding channel and at least one blocking element, the lower frame has a groove, the separation roller is mounted to the upper frame, the pickup roller is mounted to the lower frame and placed in the groove, a paper feeding channel is formed between the separation roller and the pickup roller, or between the separation roller and the lower frame, the blocking element is pivoted on the upper frame and placed beside the separation roller, the blocking element has a stopping part, the stopping part contacts the lower frame.

11 Claims, 7 Drawing Sheets

PAPER FEEDING MECHANISM

BACKGROUND OF THE INVENTION

1. Field of the Invention

The present invention relates to a paper feeding mechanism, and more particularly to a paper feeding mechanism for office equipment such as printers, scanners, photocopiers and fax machines.

2. The Related Art

Office equipment such as a printer, a scanner, a photocopier and a fax machine includes a paper feeding mechanism. A first conventional paper feeding mechanism includes a first paper feeding channel, a first swing arm and a first pickup roller, the first swing arm contacts the first pickup roller so as to block the first paper feeding channel. The first swing arm includes a pivot end and a swing end, the swing end is capable of contacting the first pickup roller or breaking away from the first pickup roller. When a first paper passes through the first paper feeding channel, the first paper pushes the first swing arm to swing upwardly. Therefore the first swing arm breaks away the first pickup roller to allow the first paper to pass through the first paper feeding channel. At this time, the first swing arm blocks the second paper adhered on the first paper so that the first paper is separated from the second paper.

In particular, when the first paper is not yet fed in the paper feeding channel, the first swing arm keeps contacting the pickup roller because of the gravity of the first swing arm. When the first pickup roller rotates, a friction is formed between the first pickup roller and the first swing arm. The friction becomes a torque to make the first swing arm rotate. The first swing arm keeps beating against the first pickup roller, so the first swing arm can not keep contacting the first pickup roller. Therefore a friction between the first swing arm and the first paper is unstable, so it reduces the ability and the stability of a paper separation function. When the first paper passes through a contacting point between the first swing arm and the first pickup roller, the swing end of the first swing arm contacts the first paper. As described above, a friction formed between the first paper and the first swing arm causes the first swing arm to keep beating against the first paper, so it reduces the ability and the stability of the paper separation function.

A second conventional paper feeding mechanism includes a second paper feeding channel, a second swing arm and a second pickup roller. The second swing arm is positioned opposite to the second pickup roller and keeps breaking away from the second pickup roller. A free end of the second swing arm extends to cross the second paper feeding channel. View from one side, the free end of the second swing arm and the second pickup roller are partial overlap. Because the second swing arm can not swing, it improves the stability of the paper separation function. Because the second swing arm can not pivot, the first paper passes under the second swing arm and feeds through the second paper feeding channel, or the first paper raises the second swing arm and then passes through a nip between the second swing arm and the second pickup roller. A angel of a contact surface of the second swing arm is used to judge whether the second swing arm is raised by the first paper.

The U.S. Pat. No. 9,114,947 discloses a third conventional paper feeding mechanism. If a angel $\Theta_{ap1}$ is small, the ability of a paper feeding function is good, but the ability of the paper separation function is poor. In another words, if a angel $\Theta_{ap1}$ is large, the ability of the paper separation function is good, but the ability of the paper feeding function is poor. In order to improve the ability of the paper separation function, the large angel $\Theta_{ap1}$ is chose. When a third swing arm of the third conventional paper feeding mechanism exert a pressure upon a thin paper, the thin paper is deformed and then passed under the third swing arm. When the third swing arm exert the same pressure upon a thick paper, the thick paper raises the third swing arm and then passed through the third swing arm. It is difficult to choose the angel $\Theta_{ap1}$ when the third conventional paper feeding mechanism is used for picking up the thin paper and the thick paper.

Neither of the above two designs can effectively improve the stability of paper separation, and it is easy to produce more than one piece of paper.

SUMMARY OF THE INVENTION

Accordingly, an object of the present invention is to provide a paper feeding mechanism. The paper feeding mechanism includes a lower frame, an upper frame, a separation roller, a pickup roller, a paper feeding channel and at least one blocking element, the lower frame has a groove, the separation roller is mounted to the upper frame, the pickup roller is mounted to the lower frame and placed in the groove, a paper feeding channel is formed between the separation roller and the pickup roller, or between the separation roller and the lower frame, the blocking element is pivoted on the upper frame and placed beside the separation roller, the blocking element has a stopping part, the stopping part contacts the lower frame.

Accordingly, an object of the present invention is to provide a paper feeding mechanism, the paper feeding mechanism includes a lower plate, an upper plate, an upper separation roller, a lower pickup roller, a paper feeding path and at least one blocking unit, the lower plate has a groove, the upper separation roller mounted to the upper plate, lower pickup roller mounted to the lower plate and placed in the groove, a paper feeding path is formed between the upper separation roller and the lower pickup roller, or between the upper separation roller and the lower plate, the blocking unit is pivoted on the upper plate and placed on two sides of the upper separation roller, the blocking unit has a stopping portion, the stopping portion contacts the lower plate.

As described above, the paper feeding mechanism is capable of stably blocking multipapers feeding to increase the probability of papers separation.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
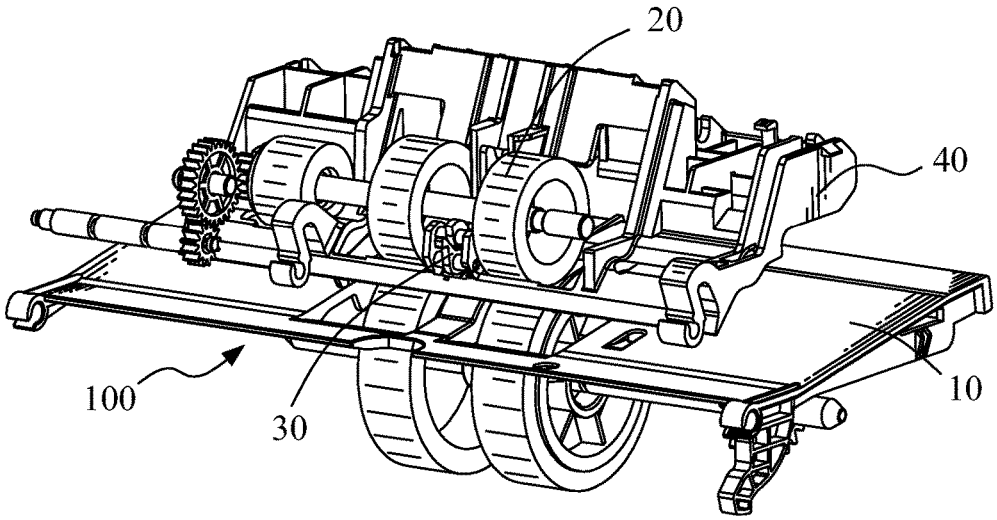
FIG. 1 is a front perspective view of a first paper feeding mechanism in accordance with an embodiment of the present invention.
Figure 2:
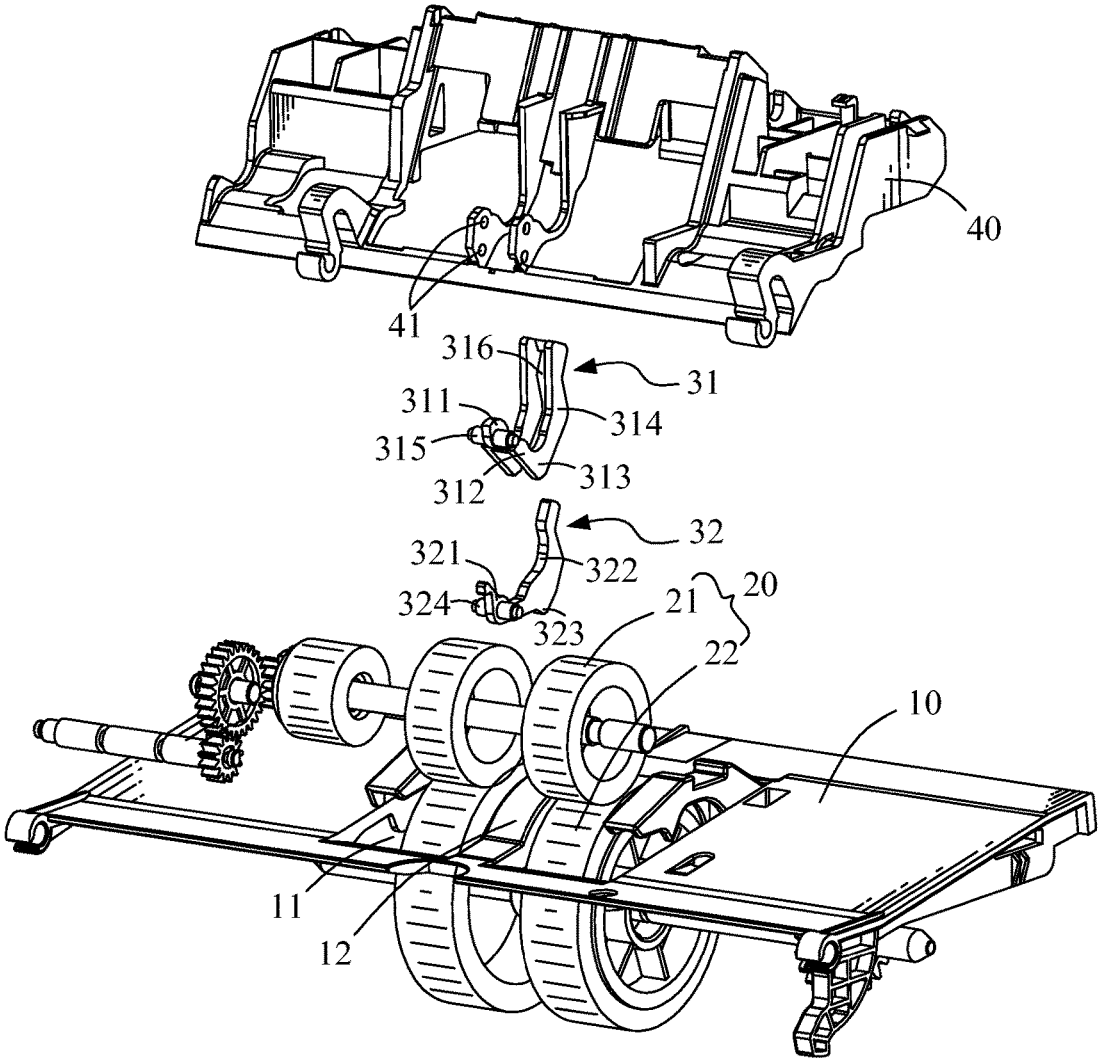
FIG. 2 is an exploded perspective view of the first paper feeding mechanism of FIG. 1.
Figure 3:
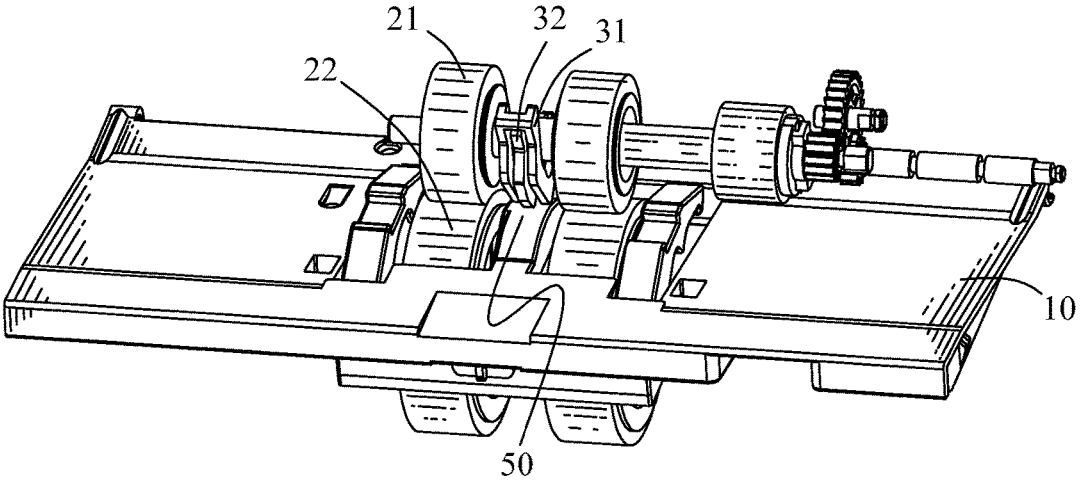
FIG. 3 is a back perspective view of the first paper feeding mechanism of FIG. 1.
Figure 4:
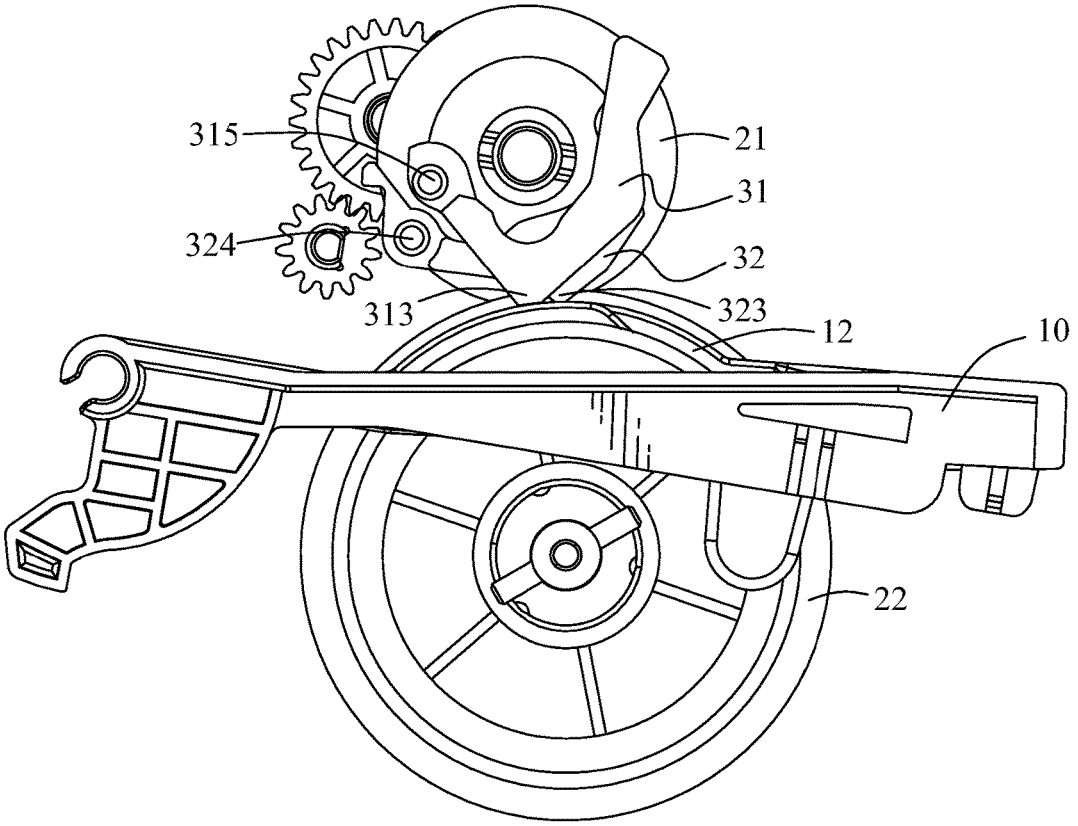
FIG. 4 is a side perspective view of the first paper feeding mechanism of FIG. 1.

Referring to FIG. 1, FIG. 2, FIG. 3 and FIG. 4, a first paper feeding mechanism 100 in accordance with an embodiment of the present invention is shown. The first paper feeding mechanism 100 is mounted to an automatic paper feeder, the automatic paper feeder has the function of scanning papers and cards. The first paper feeding mechanism 100 includes a lower frame 10, a pickup assembly 20, at least one blocking element 30 and a upper frame 40. The upper frame 40 is formed a plurality of pivoting holes 41.

The lower frame 10 has a groove 11 and a cam part 12. The groove 11 is formed in a middle of the lower frame 10. The cam part 12 is positioned beside the groove 11 and has an extension direction parallel with a longitudinal direction of the groove 11.

The pickup assembly 20 is mounted to the lower frame 10 and the upper frame 40 and is used to pickup papers. The pickup assembly 20 includes a separation roller 21 positioned at the upper frame 40 and a pickup roller 22 placed in the groove 11. Therefore, a paper feeding channel 50 is formed between the separation roller 21 and the pickup roller 22, or between the separation roller 21 and the lower frame 10. Further, the paper feeding channel 50 is formed between the cam part 12 and the separation roller 21. In this case, the groove 11 and the cam part 12 extend along the paper feeding channel 50.

The blocking element 30 is pivoted on the upper frame 40 and placed beside the separation roller 21. The blocking element 30 has a stopping part, the stopping part contacts the lower frame 10. Further, the blocking element 30 includes a first blocking element 31 and a second blocking element 32. The first blocking element 31 has a first pivoting part 311, a first swing arm 312, a first blocking part 313, a connecting arm 314, two first pivoting shafts 315 and an avoiding groove 316. In this case, the pivoting holes 41 is located at an upstream side of the separation roller 21.

The first pivoting part 311 pivots on the pivoting holes 41, the first blocking element 31 extends toward a downstream side. The first pivoting part 311 extends downward and toward the downstream side to form the first swing arm 312. The first swing arm 312 is bent upwardly to form the first blocking part 313. The blocking part 313 extends upwardly and toward the downstream side to form the connecting arm 314. A bottom surface of the first blocking part 313 is flat. Two sides of the first pivoting part 311 protrude to form the two first pivoting shafts 315. The avoiding groove 316 penetrates through the first swing arm 312, the blocking part 313 and the connecting arm 314. The voiding groove 316 extends along a longitudinal direction of the first blocking element 31. The two first pivoting shafts 315 pivot on the pivoting holes 41.

The second blocking element 32 has a second pivoting part 321, a second swing arm 322, a second blocking part 323 and two second pivoting shafts 324. The second pivoting part 321 pivots on the pivoting holes 41, the second blocking element 32 extends toward the downstream side. The second pivoting part 321 is extended downwardly and toward the downstream side, and then further bent upwardly and extended upwardly and toward the downstream side to form the second swing arm 322. The second swing arm 322 protrudes downward to form the second blocking part 323. A bottom surface of the second blocking part 323 is flat. Two sides of the second pivoting part 321 protrude to form the two second pivoting shafts 324. The two second pivoting shafts 324 pivot on the pivoting holes 41.

The first pivoting part 311 and the second pivoting part 321 pivot on the pivoting holes 41. Directions of axises of the first pivoting shaft 315 and the second pivoting shaft 324 are perpendicular to a direction of the paper feeding channel 50. The bottom surfaces of the first blocking part 313 and the second blocking part 323 contact a top surface of the cam part 12. The second blocking element 32 is placed in the avoiding groove 316. A contacting point between the first blocking part 313 and the cam part 12 and a contacting point between the second blocking part 323 and the cam part 12 are not located on the same horizontal plane. The first pivoting shaft 315 and the second pivoting shaft 324 are located at an upstream side relative to the two connecting points. In this case, the first blocking part 313 and the second blocking part 323 are together formed as the blocking part. A friction between the blocking part of the blocking element 30 and the papers prevents the blocking part beating against the papers during papers feeding. Therefore, the blocking element 30 of the first paper feeding mechanism 100 is capable of stably blocking multipapers feeding to increase the probability of papers separation.

Figure 5:
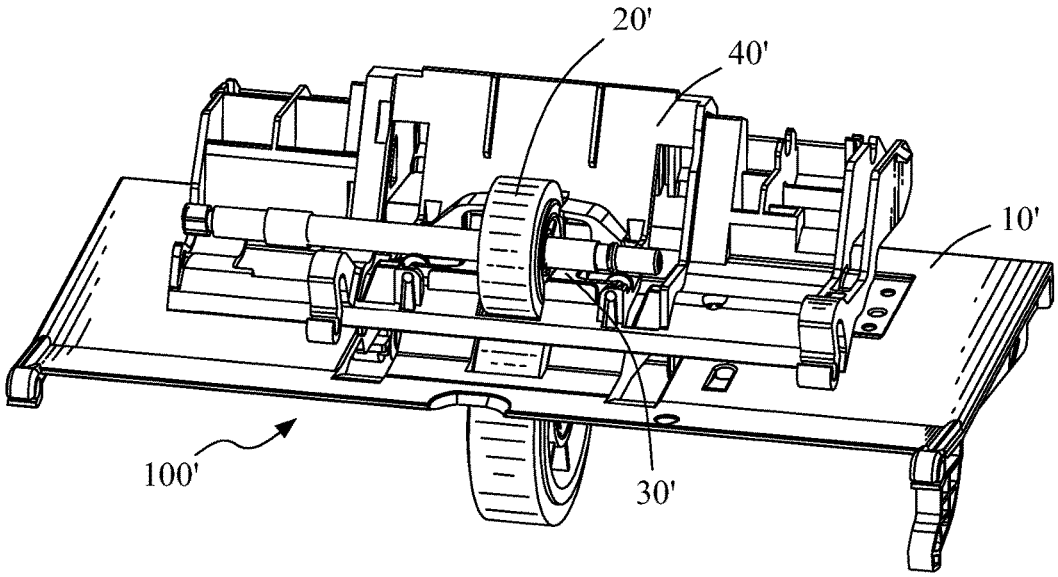
FIG. 5 is a perspective view of a second paper feeding mechanism in accordance with another embodiment of the present invention.
Figure 6:
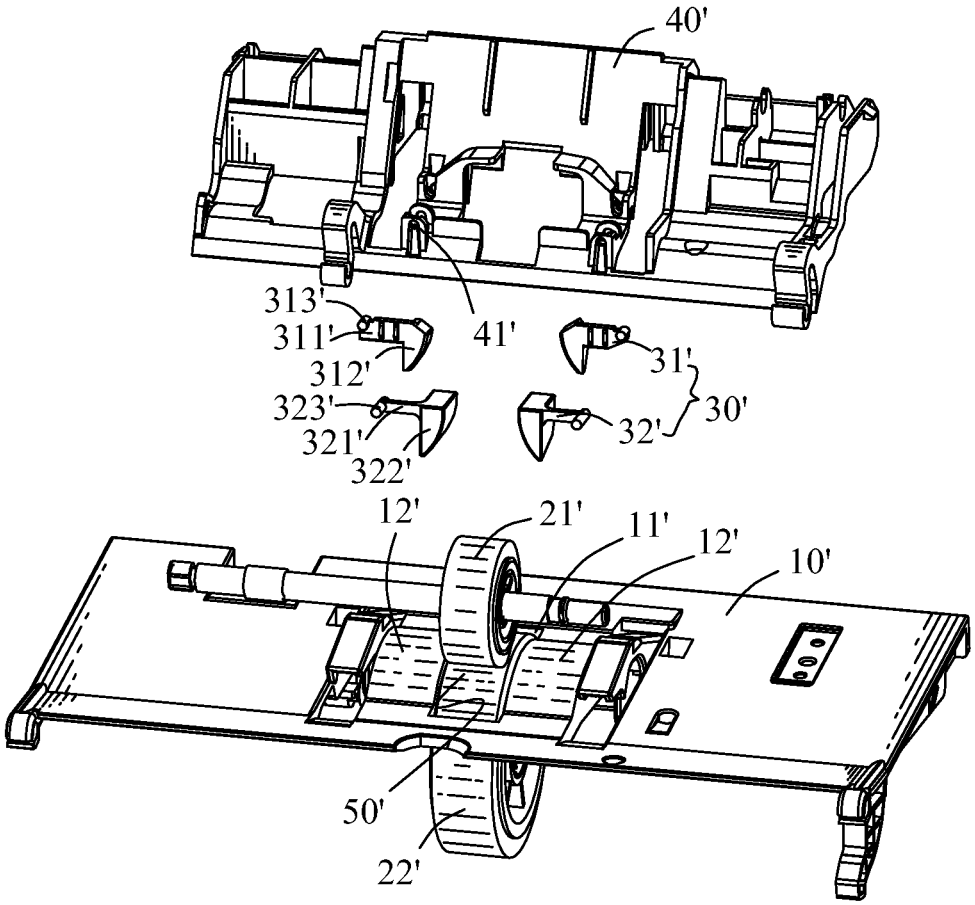
FIG. 6 is an exploded perspective view of the second paper feeding mechanism of FIG. 5.
Figure 7:
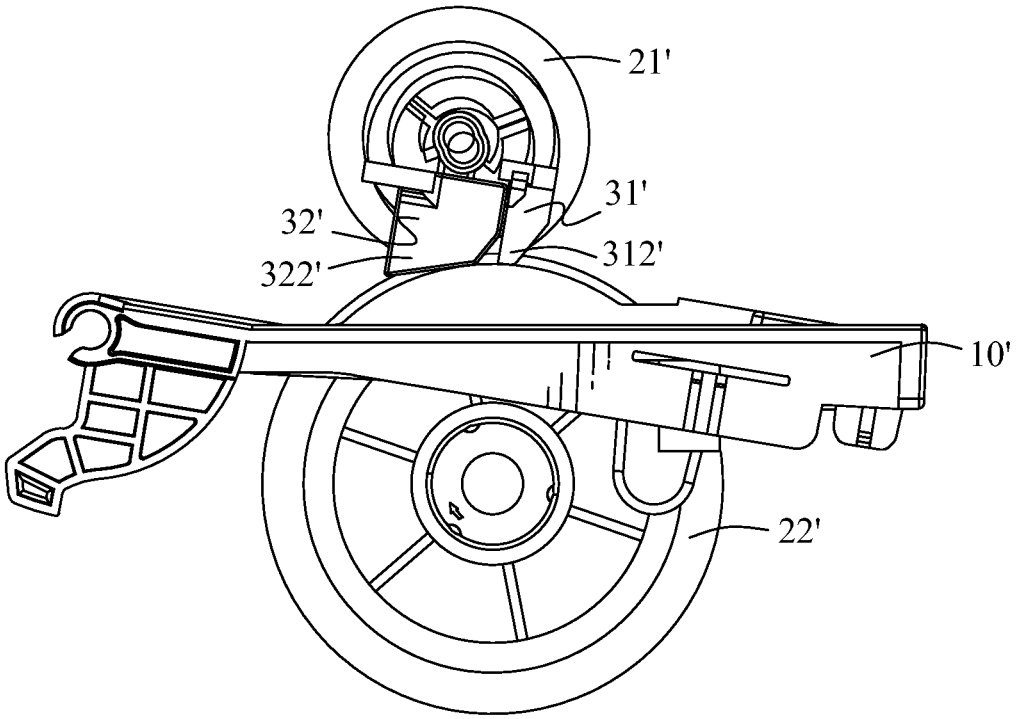
FIG. 7 is a side perspective view of the second paper feeding mechanism of FIG. 5.

Referring to FIG. 5, FIG. 6 and FIG. 7, a second paper feeding mechanism 100' in accordance with another embodiment of the present invention is shown. The second paper feeding mechanism 100' is mounted to an automatic paper feeder, the automatic paper feeder has the function of scanning papers and cards. The second paper feeding mechanism includes a lower plate 10', a roller assembly 20', at least one blocking unit 30' and a upper plate 40'. The lower plate 10' has a groove 11', the groove 11' is formed in a middle of the lower plate 10', one side of the groove 11' of the lower plate 10' protrudes upwardly to form at least one cam portion 12'. The upper plate 40' is formed a plurality of holes 41'.

The roller assembly 20' is mounted to the lower plate 10' and the upper plate 40', and used to pickup and separate papers. The roller assembly 20' includes an upper separation roller 21' and a lower pickup roller 22' placed in the groove 11'. A paper feeding path 50' is formed between the upper separation roller 21' and the lower pickup roller 22', or, between the upper separation roller 21' and the lower plate 10'. Further, the paper feeding path 50' is formed between the upper separation roller 21' and the two cam portions 12'.

The blocking unit 30' is pivoted on the upper plate 40' and placed on two sides of the upper separation roller 21'. The blocking unit 30' has a stopping portion, the stopping portion contacts the lower plate 10'. Further, the blocking unit 30' includes a first blocking unit 31' and a second blocking unit 32'. The first blocking unit 31' has a first pivoting portion 311', a first blocking portion 312' and two first pivoting posts 313'. In this case, the first pivoting portion 311' pivots on the holes 41'. The first blocking unit 31' and the second blocking unit 32' are positioned at one side of the upper separation roller 21' and extended toward the upper separation roller 21'. Therefore, an extension direction of the first blocking unit 31' is perpendicular to an extension direction of the paper feeding path 50'. An axis of each of the two first pivoting posts 313' is parallel with the extension direction of the paper feeding path 50'. A free end of the first pivoting portion 311' extends toward the cam portion 12' and bends downwardly to form the first blocking portion 312'. A bottom surface of the first blocking portion 312' is flat. Two sides of the first pivoting portion 311' protrude outward to form the two first pivoting posts 313'. The second blocking unit 32' positioned at the same side of the upper separation roller 21' with the first blocking unit 31' and extended toward the upper separation roller 21'. Therefore, an extension direction of the second blocking unit 32' is perpendicular to the extension direction of the paper feeding path 50'. The first blocking unit 31' and the second blocking unit 32' are positioned from an upstream side to a downstream side.

The second blocking unit 32' has a second pivoting portion 321', a second blocking portion 322' and two second blocking portions 323'. A free end of the second pivoting portion 321' extends toward the cam portion 12' and bends downwardly to form the second blocking portion 322'. A bottom surface of the second blocking portion 312' is flat. Two sides of the second pivoting portion 321' protrude outward to form the two second pivoting posts 323'. An axis of each of the two second pivoting posts 323' is parallel with the extension direction of the paper feeding path 50'. In this case, the first blocking unit 31' is located at a downstream position relate to the second blocking unit 32'. The second blocking portion 322' is more thick than the first blocking portion 312'. An area of the bottom surface of the second blocking portion 322' is larger than an area of the bottom surface of the first blocking portion 312'

The first pivoting portion 311' and the second pivoting portion 321' are pivoted to the holes 41'. The second blocking unit 32' and the first blocking unit 31' are arranged from the upstream to the downstream of the paper feeding path 50'. The bottom surfaces of the first blocking portion 312' and the second blocking portion 322' contact a top surface of the cam portion 12'. A contacting point between the first blocking portion 312' and the cam portion 12', and a contacting point between the second blocking portion 322' and the cam portion 12 are not located on the same horizontal plane. In this case, the first blocking portion 312' and the second blocking portion 322' are together form as the stopping portion. A friction between the blocking portion of the blocking unit 30' and the papers prevents the blocking portion beat against the papers during papers feeding. Therefore, the blocking unit 30' of the second paper feeding mechanism 100' is capable of stably blocking multipapers feeding to increase the probability of papers separation. Specially, the second blocking portion 322' is more thick than the first blocking portion 312'. An area of the bottom surface of the second blocking portion 322' is larger than an area of the bottom surface of the first blocking portion 312'.

When the first paper feeding mechanism 100 is at work, the paper feeding assembly 20 feeds a first piece of papers, the first piece of papers pushes the blocking element 30 and enters into the paper feeding channels 50. The blocking element 30 produces a torque T1 because of the weight itself, and the blocking element 30 presses downward. Therefore, a friction is produced between the blocking element 30 and the first piece of papers. The friction along the paper feeding channel 50 produces a torque T2. In the process of feeding papers, a friction is produced between the first piece of papers and a second piece of papers, the first piece of paper carries the second piece of paper to enter the paper feeding channel 50. The second piece of paper is blocked by the blocking element 30 and exerts a force upon the blocking element 30 along the paper feeding channel 50, which produce a torque T3. The rotation directions of the torque T1, the torque T2 and the torque T3 are the same so that the first piece of paper is pressed tightly by the blocking element 30. So the blocking element 30 is prevented from beat against the first piece of papers to increase the probability of paper separation.

When the second paper feeding mechanism 100' is at work, the roller assembly 20' feeds a first piece of papers, the first piece of papers pushes the blocking unit 30' and enters into the paper feeding path 50'. The blocking unit 30' produces a torque T1 because of the weight itself, and the blocking unit 30' presses downward. Therefore, a friction is produced between the blocking unit 30' and the first piece of papers. The friction along the paper feeding path 50' produces a torque T2. In the process of feeding papers, a friction is produced between the first piece of papers and a second piece of papers, the first piece of paper carries the second piece of paper to enter the paper feeding path 50'. The second piece of paper is blocked by the blocking unit 30' and exerts a force upon the blocking unit 30' along the paper feeding path 50', which produce a torque T3. The rotation directions of the torque T1, the torque T2 and the torque T3 are the same so that the first piece of paper is pressed tightly by the blocking unit 30'. So the blocking unit 30' is prevented from beat against the first piece of papers to increase the probability of paper separation.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A paper feeding mechanism comprising:

a lower frame having a groove;

an upper frame;

a separation roller mounted to the upper frame;

a pickup roller mounted to the lower frame and placed in the groove;

a paper feeding channel formed between the separation roller and the pickup roller, or between the separation roller and the lower frame; and at least one blocking element pivoted on the upper frame and placed beside the separation roller, the blocking element having a stopping part, the stopping part contacting the lower frame;

wherein the blocking element has a pivoting shaft, a direction of an axis of the pivoting shaft is perpendicular to a direction of the paper feeding channel, the pivoting shaft is located at an upstream side relative to a connecting point between the blocking element and the lower frame; and wherein the upper frame is formed a plurality of pivoting holes, the lower frame has a cam part, the cam part is positioned beside the groove and has an extension direction parallel with a longitudinal direction of the groove; the blocking element includes a first blocking element and a second blocking element, the first blocking element has a first pivoting part, a first swing arm, a first blocking part, a connecting arm, two first pivoting shafts and an avoiding groove, the first pivoting part pivots on the pivoting holes, the first blocking element extends toward a downstream side, the first pivoting part extends downward and toward the downstream side to form the first swing arm, the first swing arm is bent upwardly to form the first blocking part, the blocking part extends upwardly and toward the downstream side to form the connecting arm, two sides of the first pivoting part protrude to form the two first pivoting shafts, the two first pivoting shafts pivot on the pivoting holes, the avoiding groove penetrates through the first swing arm, the blocking part and the connecting arm, the voiding groove extends along a longitudinal direction of the first blocking element; the second blocking element has a second pivoting part, a second swing arm, a second blocking part and two second pivoting shafts, the second pivoting part pivots on the pivoting holes, the second blocking element extends toward the downstream side, the second pivoting part is extended downwardly and toward the downstream side, and then further bent upwardly and extended upwardly and toward the downstream side to form the second swing arm, the second swing arm protrudes downward to form the second blocking part, two sides of the second pivoting part protrude to form the two second pivoting shafts, the two second pivoting shafts pivot on the pivoting holes.

2. The paper feeding mechanism as claimed in claim 1, wherein a bottom surface of the first blocking part is flat and a bottom surface of the second blocking part is flat.

3. The paper feeding mechanism as claimed in claim 2, wherein a contacting point between the first blocking part and the cam part and a contacting point between the second blocking part and the cam part are not located on the same horizontal plane.

4. A paper feeding mechanism comprising:

a lower plate having a groove;

an upper plate;

an upper separation roller mounted to the upper plate;

a lower pickup roller mounted to the lower plate and placed in the groove;

a paper feeding path formed between the upper separation roller and the lower pickup roller, or between the upper separation roller and the lower plate; and at least one blocking unit pivoted on the upper plate and placed beside the upper separation roller, the blocking unit having a stopping portion, the stopping portion contacting the lower plate;

wherein the upper plate is formed a plurality of holes, the lower frame has at least one cam portion, one side of the groove of the lower plate protrudes upwardly to form the cam portion; the blocking unit has a first blocking unit and a second blocking unit, the first blocking unit has a first pivoting portion, a first blocking portion and two first pivoting posts, the first pivoting portion pivots on the holes, the first blocking unit and the second blocking unit are positioned at one side of the upper separation roller and extended toward the upper separation roller, a free end of the first pivoting portion extends toward the cam portion and bends downwardly to form the first blocking portion, two sides of the first pivoting portion protrude outward to form the two first pivoting posts; the second blocking unit has a second pivoting, a second blocking portion and two pivoting posts, a free end of the second pivoting portion extends toward the cam portion and bends downwardly to form the second blocking portion, two sides of the second pivoting portion protrude outward m the two second pivoting posts.

5. The paper feeding mechanism as claimed in claim 4, wherein the blocking unit includes a pivoting post, an extension direction of the blocking unit is perpendicular to an extension direction of the paper feeding path, an axis of the pivoting post is parallel with the extension direction of the paper feeding path.

6. The paper feeding mechanism as claimed in claim 4, wherein a bottom surface of the first blocking portion is flat and a bottom surface of the second blocking portion is flat.

7. The paper feeding mechanism as claimed in claim 6, wherein a contacting point between the first blocking portion and the cam portion, and a contacting point between the second blocking portion and the cam portion are not located on the same horizontal plane.

8. The paper feeding mechanism as claimed in claim 7, wherein two sides of the upper separation roller arrange two blocking units respectively.

9. The paper feeding mechanism as claimed in claim 7, wherein the first blocking unit and the second blocking unit are positioned from an upstream side to a downstream side.

10. The paper feeding mechanism as claimed in claim 7, wherein the second blocking portion is more thick than the first blocking portion.

11. The paper feeding mechanism as claimed in claim 7, wherein an area of the bottom surface of the second blocking portion is larger than an area of the bottom surface of the first blocking portion.

* * * * *